US006053817A

United States Patent [19]

Fiegel

[11] Patent Number: 6,053,817

[45] Date of Patent: Apr. 25, 2000

[54] CAROM GUIDE FOR POCKET BILLIARDS

[76] Inventor: Lester D. Fiegel, 219 N. 8th Ave., Winneconne, Wis. 54986

[21] Appl. No.: 09/085,270

[22] Filed: May 26, 1998

[51] Int. Cl.[7] ..... A63D 15/00

[52] U.S. Cl. ..... 473/2; 473/52

[58] Field of Search ..... 473/2; 273/267, 273/271, 236

[56] References Cited

U.S. PATENT DOCUMENTS 3,220,122 11/1965 Miller ..... 473/2
3,704,887 12/1972 Thorton ..... 473/2
3,947,026 3/1976 Scoutten ..... 473/2
4,120,494 10/1978 Roe ..... 473/2

*Primary Examiner*—Jeanette Chapman
*Assistant Examiner*—V K Mendiratta

[57] ABSTRACT

The invention provides a carom guide for the three carom shots for pocket billiards or pool. The carom guide is adaptable for placement on the playing surface of a pool table, for the game of pocket billiards or pool utilizing a cue ball, an object ball, and a carom ball. The guide comprises a fabric adaptable for temporary placement on the playing surface of the pool table, and is provided with markings or spots for the placement of the object ball and the carom ball, and lines extend from the object ball showing the direction of travel for contact or impact with the carom ball and the direction of travel to the pocket.

7 Claims, 6 Drawing Sheets

CAROM GUIDE FOR POCKET BILLIARDS

FIELD OF INVENTION

This invention relates to a carom guide for pocket billiards or pool. In its more specific aspect, this invention relates to a training device or practicing guide for the three basic carom shots for pocket billiards or pool.

BACKGROUND AND PRIOR ART

Pocket billiards which, especially in the United States, is more popularly known as pool, is a game requiring considerable skill and knowledge, and acquired only after long hours of practice. In order to improve a players skill, a number of training devices and table accessories have been proposed for use by the player during practice and training sessions. The prior art shows a number of examples of such devices and accessories.

For example, U.S. Pat. No. 3,704,887 discloses a guide utilizing spots and rings drawn on a table surface for teaching the aiming technique for pool shots, especially angle shots. U.S. Pat. No. 4,120,494 discloses a training device comprising a planar material placed on the playing surface having pre-arranged indicia for teaching angle shots. Mechanical devices are disclosed in U.S. Pat. Nos. 2,537,228 and 5,144,415 showing rebound angle indicators for teaching bank shots. Other mechanical training devices are disclosed in U.S. Pat. Nos. 3,220,122; 3,299,537; and 5,125,652.

In all games of pocket billiards or pool, a player seeks to pocket or sink an object ball (sometimes known as the called ball), and to leave the cue ball in good position for the next shot. However, no matter how skillful a player may become in the game of pool, he frequently has relatively poor position and his only plausible shot may be a carom shot. A carom shot, however, probably requires more skill and knowledge than most, if not all, other shots. As a consequence, a carom shot is not frequently employed by the player, especially the novice or amateur.

A carom shot, as this term is used in pocket billiards, is defined as a shot when the cue ball strikes the object ball or called ball (the ball intended to be pocketed), which in turn strikes or impacts another ball (known as the carom ball), and the object ball, impacting or glancing off the carom ball, is then directed to the pocket, or, as is commonly stated, the object ball is pocketed. In pocket billiards, there are three carom shots: namely, frozen carom, banking carom, and direct carom. In the first of these shots, known as the frozen carom, the object ball and carom ball, while at rest on the playing surface of the table, are touching or frozen. For this shot, the cue ball strikes the object ball, which is immediately driven or glanced off the carom ball, and the object ball is then pocketed. For the second carom shot, identified as the banking carom, the cue ball strikes the object ball which then banks off the cushion or rail, then strikes or glances the carom ball, and the object ball is then pocketed. In the third carom shot, identified as the direct carom, the cue ball strikes the object ball which strikes or impacts an edge of the carom ball, and this glance directs the object ball to the pocket.

From this definition of carom shots, and the description of the three types, it will be observed that these shots are relatively difficult. It is, however, a very useful shot, and probably requires more skill and practice than most other shots. It certainly is a shot that distinguishes the skilled player from the novice. However, the skill and proper aiming technique required for carom shots can be developed with practice and guidance.

This invention has therefore as its purpose to provide a training device or carom guide for teaching and practicing carom shots.

It is another object of my invention to provide such a carom guide that is useful as a teaching tool for all level of players.

It is another object of my invention to provide such a carom guide that is easy to use and to put into practice.

SUMMARY OF THE INVENTION

In accordance with my invention, I have provided a carom guide for the three carom shots for pocket billiards or pool. The carom guide is adaptable for placement on the playing surface of a pool table, for the game of pocket billiards or pool utilizing a cue ball, an object ball, and a carom ball. The guide comprises a web (e.g., fabric) adaptable for temporary placement on the playing surface of the pool table. The web is provided with markings or spots for the placement of the object ball and the carom ball, and a first line extending from about the center of the object ball showing the direction of travel for contact or impact with the carom ball, and a second line for indicating the direction of travel for the object ball to the pocket. It should be understood that the phrase "center of the ball" as used herein and in the appended claims means the point on the playing surface of the table defined by the center vertical axis of the ball.

DETAILED DESCRIPTION OF THE INVENTION

Figure 1:
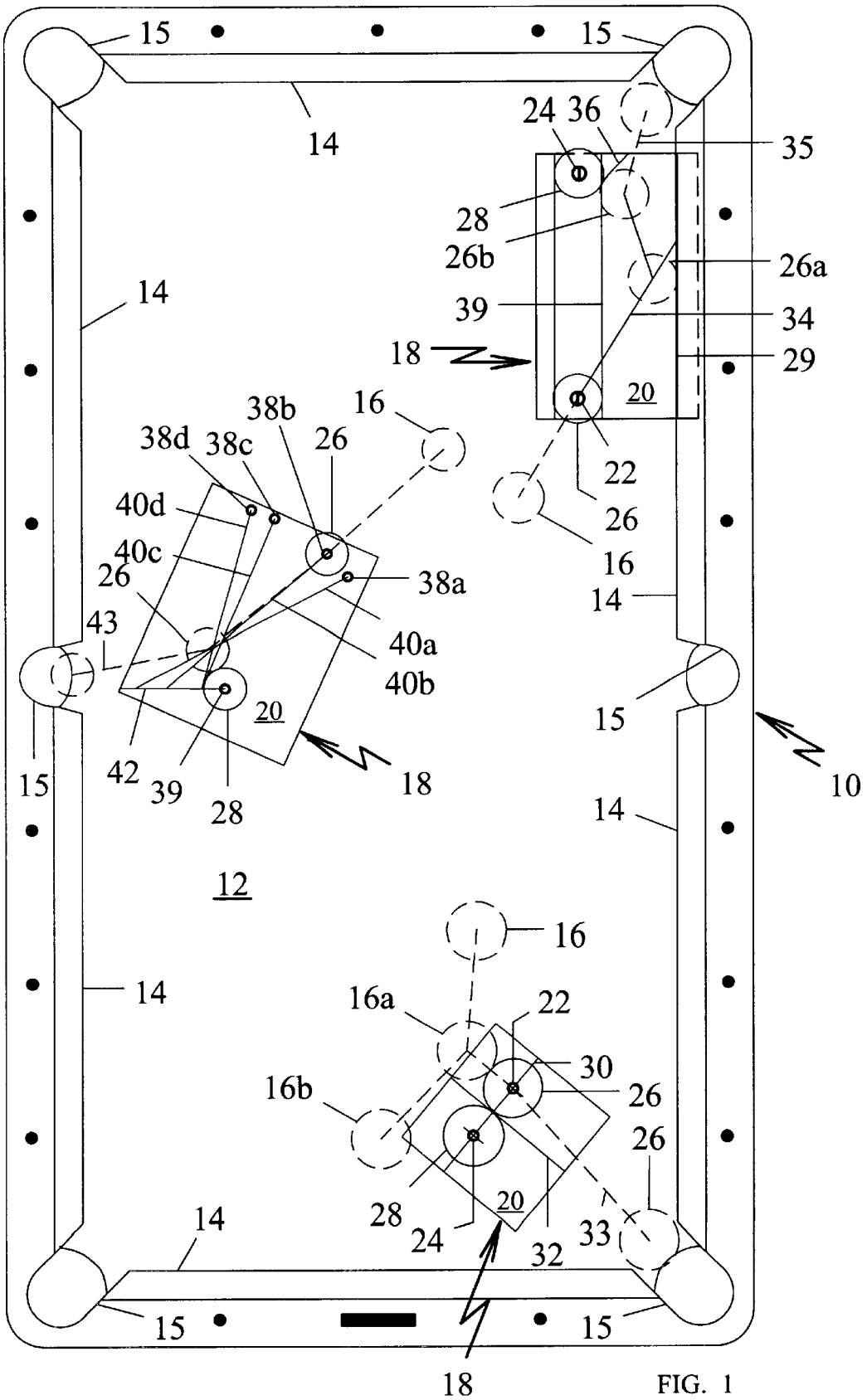
FIG. 1 is a plan view of the playing surface of a pool table with the training devices of the present invention positioned on the playing surface of a typical pool table.
Figure 1A:
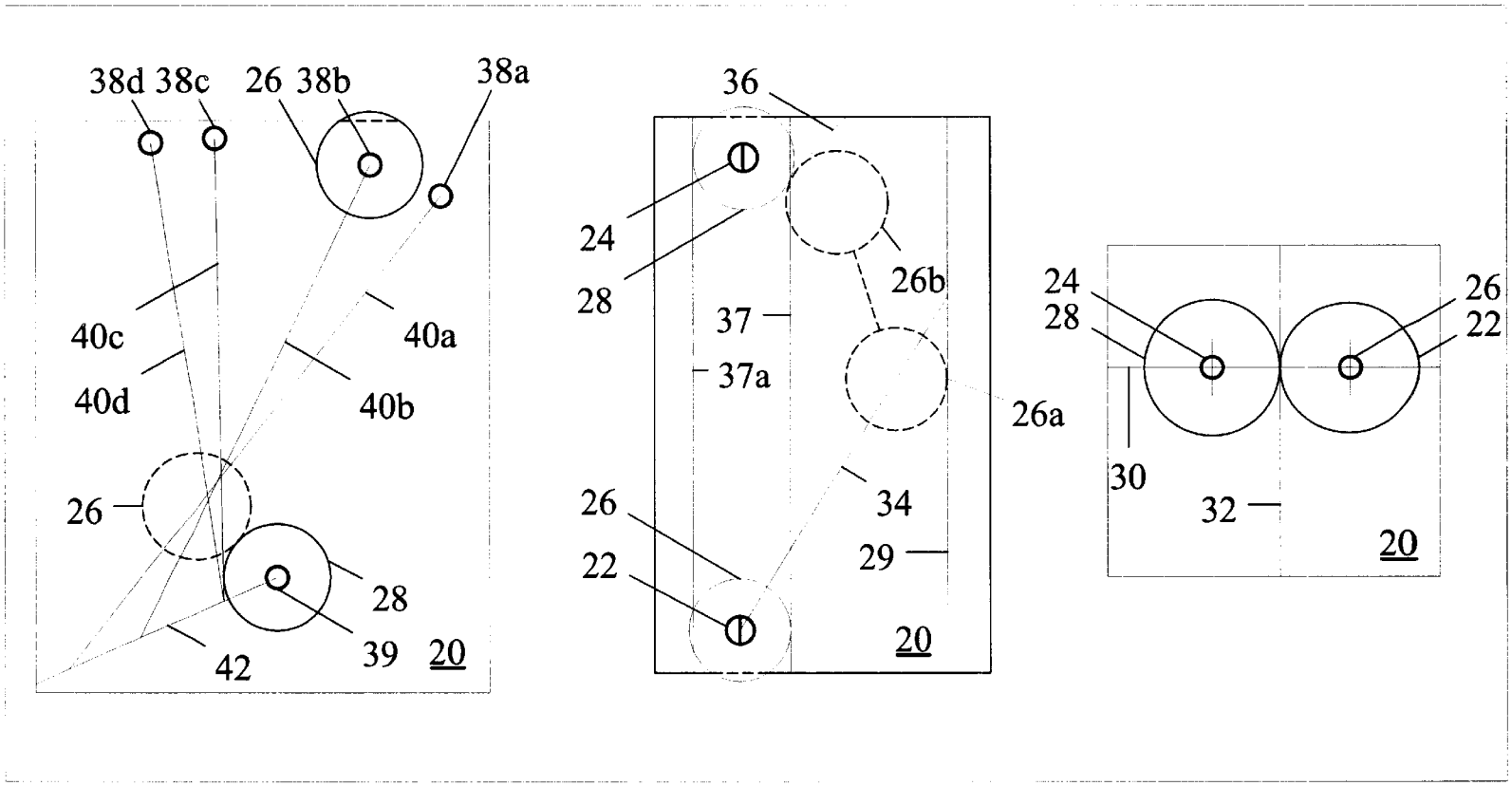
FIG. 1A is a plan view of the training device of the present invention for placement on the playing surface of a pool table for use in teaching all three carom shots.

In referring to the drawings, wherein like reference numerals designate similar parts throughout the several views, there is illustrated a pool table, indicated generally by the numeral 10, having a rectangular playing surface 12 outlined or circumscribed by the resilient cushion 14 (sometimes referred to as rail or bumper), and with four corner and two side pockets 15. The playing surface of a standard pool table is twice as long as it is wide, as for example a table can measure 3 ½ feet×7 feet, 4 feet×8 feet, or 5 feet×10 feet. Also, the playing surface 12 and resilient cushion 14 are covered with a one piece fabric or cloth, most typically felt in a solid color such as green, drawn taut over slate so as to eliminate any wrinkles. All games are played with a cue ball 16 and a designated number of object balls, depending upon the game, up to a maximum of 15 object balls for standard pocket billiards and 21 object balls for snooker.

There is shown in the Figures, a training device or guide 18 for carom shots, comprised of a web 20 formed of a planar material bearing the markings or pattern for a carom guide, as explained below in detail, and the web is adaptable for temporary placement on the playing surface 12. FIG. 1 shows the three training devices on the playing surface of a pool table, but it should be understood that each guide can be moved to different positions. As shown in FIG. 1, a cue ball 16 is shown for each set-up. The web may bear the pattern for one type of carom shot only, or the web may be large enough to bear the pattern for two or all three of the carom shots. Preferably, the web 20 is of essentially the same material as the cloth covering the playing surface 12, e.g. felt, and may be of the same color or a contrasting color, but where desired the web may be of other suitable material such as paper or plastic. The area of the web 20 should be sufficient to provide all the necessary markings or pattern for at least one carom shot, as explained below, and may be as large as the playing surface. A relatively smaller web with a pattern for a single carom shot is advantageous in that the web can be moved to different positions on the table in order to provide the player with practice for all six pockets 15. Also, the web 20 should be thin so as not to misdirect or upset any shots.

Figure 2:
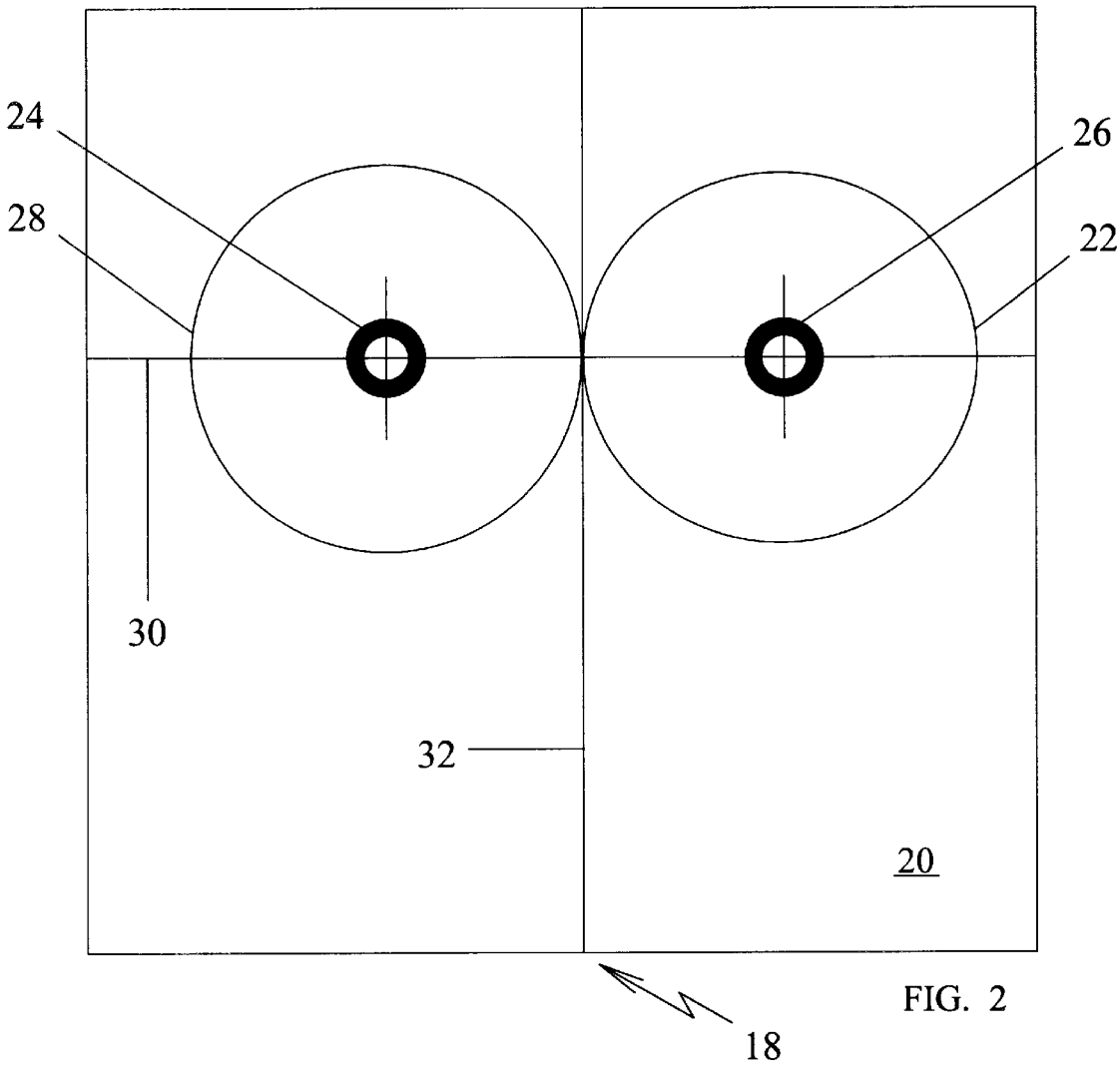
FIG. 2 is a plan view of the training device of the present invention for placement on the playing surface of a pool table for use in teaching a frozen carom shot.

Referring now to FIG. 2 illustrating the frozen carom guide, web 20 has two spots or rings 22 and 24, which are spaced apart so that when a billiard ball is placed on each spot, the balls are touching or frozen. Thus, when an object ball 26 and carom ball 28 are positioned on spots 22 and 24, respectively, the balls are frozen. A single, straight line 30, preferably drawn with an indelible material such as an ink, extends through the center of each spot and hence bisects each ball at the vertical axis. Directly beneath the point of contact between the two balls, line 32 is drawn perpendicular to line 30 and extends to about the edge of the guide, which is positioned so that line 32 projects to about the center of the pocket, as shown in FIG. 1.

When practicing the frozen carom shot with guide 18, the web 20 is placed on the playing surface of the table (see FIG. 1) so that line 32 extends and projects in the direction of a pocket, preferably to about the center of the pocket. A playing ball is placed on each of the spots 22 and 24, and the cue ball 16 is placed on the playing surface behind or to the side of the two playing balls. The cue ball can be at any distance from the playing balls, and at any angle which permits contact with the object ball, provided the shot is "on" meaning that line 32 extends from between the two balls toward about the center of the pocket so that the object ball will be pocketed. Thus, when the cue ball 16 is stroked with a standard cue stick, the cue ball hits the object ball 26, which makes contact with the carom ball 28. In this instance, the contact is essentially instantaneous. The indicated line of travel for the object ball is line 32, and upon impact, the object ball travels in the direction of line 32 and will be pocketed. In actual practice or playing, the object ball 26 travels along line 33 (as shown in phantom) and into the pocket (see FIG. 1). It will be observed that for this case the object ball and the carom ball are interchangeable, depending upon the position of the cue ball and the players preference. As shown in FIG. 1, if the cue ball 16 is hit with a center-ball stroke, the cue ball 16*a* at impact with the object ball 26 will deflect and travel to approximate position 16*b*. The carom shot is difficult, and by practicing with the carom guide of my invention, the player will learn which shots are on and which shots will miss.

Figure 3:
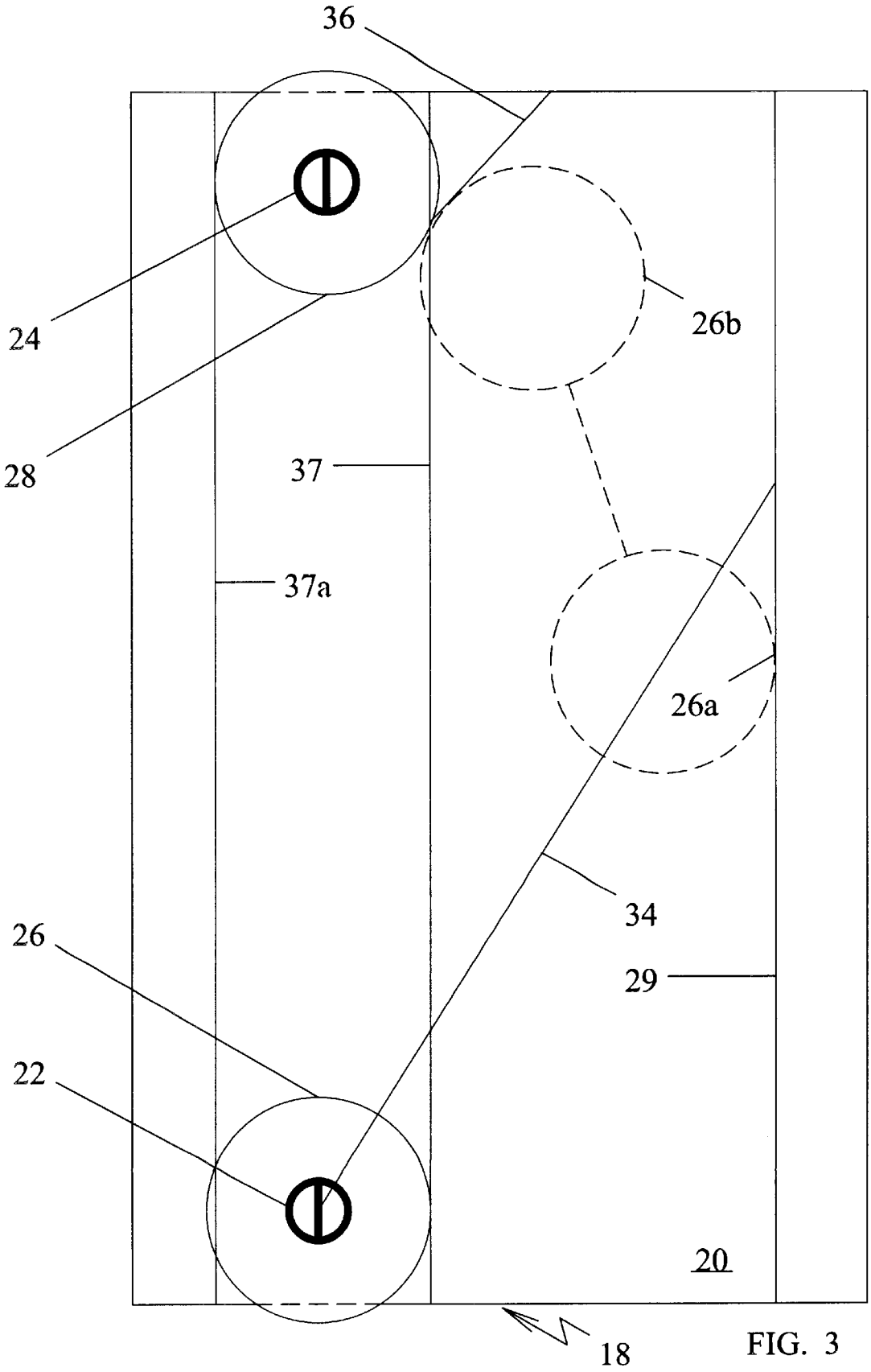
FIG. 3 is a plan view of the training device of the present invention for placement on the playing surface of a pool table for use in teaching a banking carom shot.
Figure 3A:
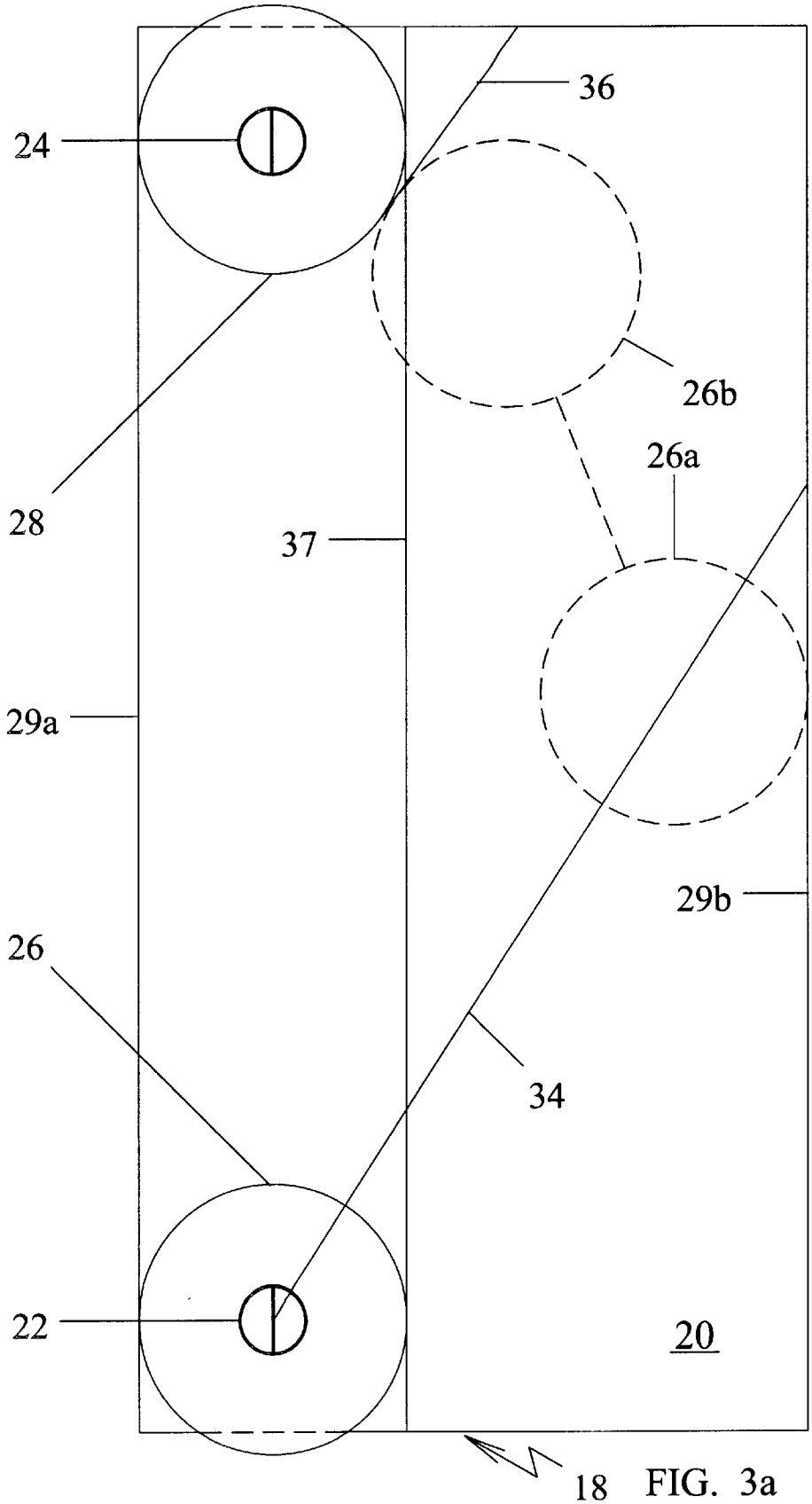
FIG. 3A is a plan view of a modification of the training device for a banking carom.

There is illustrated in FIG. 3 and FIG. 3A a carom guide for a banking carom. In using this guide, one edge of the guide is aligned with the rail 14 so that the edge is substantially parallel with the rail. The web as shown in FIG. 3A has opposed, parallel longitudinal edges 29*a* and 29*b*, and a marking for the carom ball is spaced from one of the longitudinal edges of the web by about at least one-half the diameter (i.e., radius) of the carom ball, and further includes an additional marking spaced inwardly from the marking for the carom ball a distance equal to the radius of the carom ball. Because the guide tends to fray along the edge, it is preferable to provide longitudinal line 29 which is substantially parallel to the edge (see FIG. 3), so that when the guide is positioned on the table, line 29 is aligned with the rail which inclines from the horizontal, and the edge of the guide then extends beneath the rail and is out of play. Thus, as seen in FIG. 1, when the guide is in position, line 29 and the edge of the rail coincide. The object ball 26 and the carom ball 28 are positioned on spaced apart spots 22 and 24, respectively, which are spaced from the cushion and near the longitudinal edge opposed to line 29. Because of the relative placement of the balls, or because of other balls on the table interfering with a more direct shot, the only shot available is the banking carom. The first line 34, which for this guide may be thought of as a branched line because of the banking, extends from spot 22 to the cushion and banks off the cushion to the carom ball 28. Thus, when the cue ball 16 strikes the object ball 26, the object ball travels the path outlined by line 34 to the rail, and then banks off the rail at 26*a* for impact with the carom ball at position 26*b*. If the cue ball 16 is hit with a center-ball stroke, the angle of incidence will equal the angle of reflectance, but hitting the cue ball with English will alter the angles. Second line 36 extends from the point of contact between the object ball 26 and carom ball 28 to about the center of the pocket. As explained above with reference to the frozen carom shot, the guide is placed on the playing surface so that line 36 extends toward the pocket. The object ball and carom ball are placed on their respective spots, and the cue ball is positioned so that it will strike the object ball which will follow line 34. When the object ball impacts the carom ball, the object ball then travels in the direction of line 36 to the pocket. (The object ball, in actual playing, follows line 35.) For purposes of clarity and to better illustrate the guide and line 36, the dimensions of the guide have been exaggerated to show added length to line 36, but preferably the edge of the guide is at about the center of the carom ball so as not to hinder travel and direction of the object ball. Where desired, a marking 37, and preferably as a line which is substantially parallel with the longitudinal edge of the guide and spaced from spot 24 a distance equal to the radius of the ball, helps to assure the player that the carom ball 28 is placed directly on the spot 24. It is preferable to provide a pair of lines 37 and 37*a* spaced apart equal to the diameter of the ball and parallel to the edge of the guide.

Figure 4:
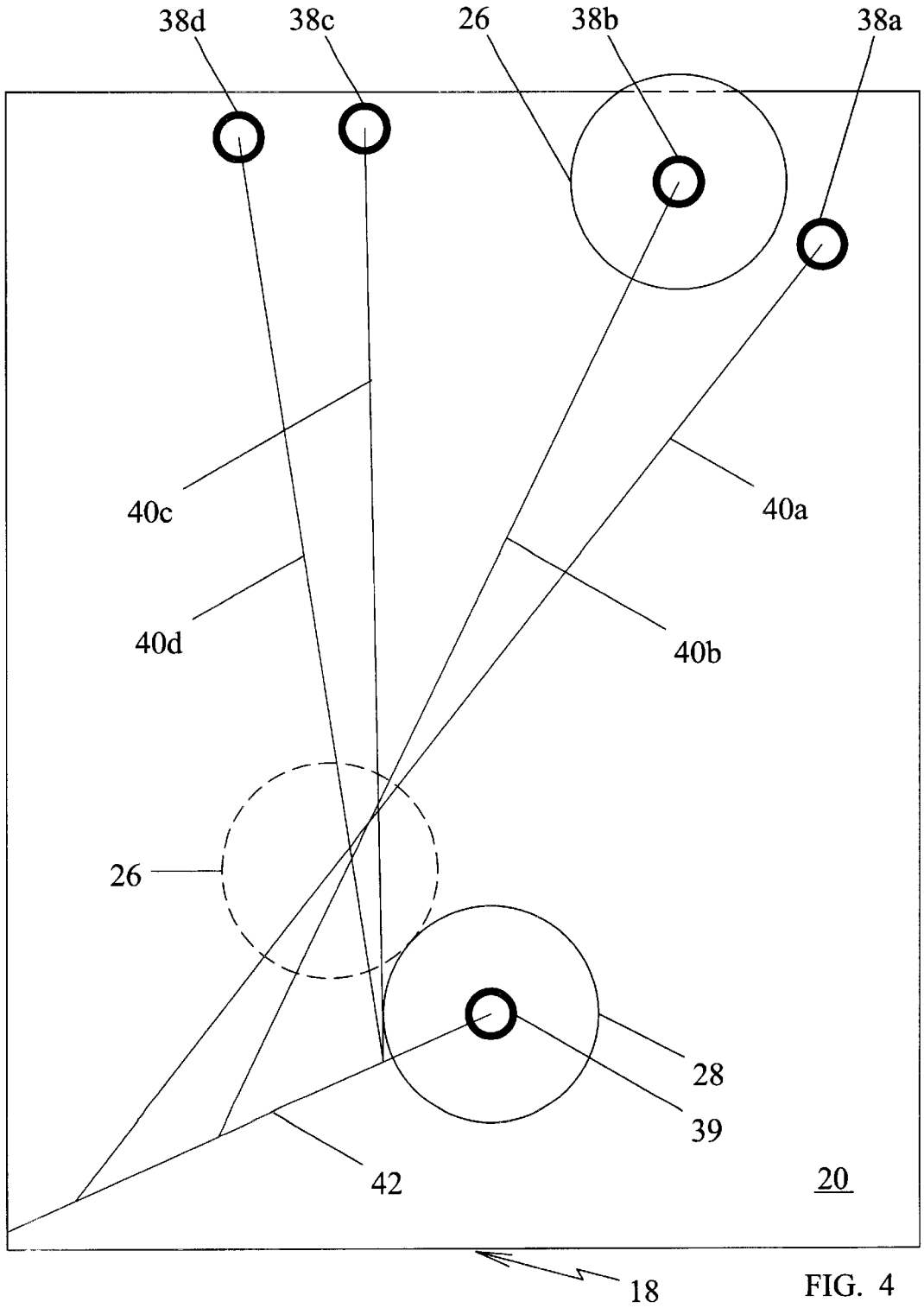
FIG. 4 is a plan view of the training device of the present invention for placement on the playing surface of a pool table for use in teaching a direct carom shot.

FIG. 4 illustrates the direct carom guide for a direct carom shot. In this embodiment of my invention, there is illustrated four different spots 38*a*, 38*b*, 38*c*, and 38*d* for placement of the object ball 26 and one spot 39 for placement of the carom ball 28. First lines 40*a*, 40*b*, 40*c* and 40*d* extend from one of the spots designating the center of the object ball for travel for impact with the carom ball 28. Second line 42 extends from the carom ball toward about the center of the pocket. Thus, in practice with the guide in place, when the cue ball 16 strikes the object ball 26, as shown in FIGS. 1 and 4, the object ball travels the path of one of the first lines depending upon the placement of the object ball (line 40*b* in the drawings), impacts the carom ball 28, and then travels in the direction of line 42 to the pocket (but in actual playing, follows line 43).

It will be observed that the invention provides for several advantages useful for teaching and practicing the three basic carom shots. Further, it should be understood that the foregoing detailed description has been given for clearness of understanding only, and no unnecessary limitations should be understood therefrom, as modifications will be obvious to those skilled in the art.

What is claimed is:

1. A carom guide for placement on the playing surface of a pool table having corner and side pockets and bordered by a raised cushion, and utilizing the cue ball, an object ball, and a carom ball, comprising: a web adaptable for the temporary placement on the playing surface of a pool table, said web having (a) markings for placement of the object ball and the carom ball, and (b) a first line extending from the object ball showing the direction of travel for contact with the carom ball, and a second line indicating the direction of travel for the object ball upon contact with the carom ball to a pocket.

2. A carom guide according to claim 1 wherein said marking for the object ball and the carom ball place the balls in contact while at rest, and said second line extends from the point of contact between the object ball and the carom ball to the pocket.

3. A carom guide according to claim 1 wherein said markings for the object ball and the carom ball place the balls apart, said first line extends from the object ball to a cushion, and said second line extends from the point of contact between the object ball and the carom ball to a pocket.

4. A carom guide according to claim 1 wherein said markings for the object ball and the carom ball place the balls apart, wherein said first line extending from the object ball to the carom ball for contact, and said second line indicating the direction of travel for the object ball upon contact with the carom ball to a pocket.

5. A carom guide according to claim 3 wherein said web having opposed, parallel longitudinal edges, a marking for said carom ball spaced from one of said longitudinal edges of said web by about at least one-half the diameter of said carom ball and further including an additional marking spaced inwardly from said marking for said carom ball a distance equal to the radius of the carom ball.

6. A carom guide according to claim 3 wherein said web having opposed, parallel longitudinal edges, and further including a longitudinal line substantially parallel with one of said longitudinal edges for aligning said web with said cushion.

7. A carom guide according to claim 3 wherein said web having opposed, parallel longitudinal edges, a pair of spaced longitudinal lines each substantially parallel with the opposed said longitudinal edges for aligning said web with said cushion, a first marking for said carom ball spaced from one of said longitudinal lines by about the radius of said carom ball, and an additional marking spaced inwardly from said first marking for said carom ball a distance equal to about the radius of said carom ball.

* * * * *